US010183459B2

(12) United States Patent
Perini

(10) Patent No.: US 10,183,459 B2
(45) Date of Patent: Jan. 22, 2019

(54) MACHINE AND METHOD FOR PRODUCING CARDBOARD TUBES

(71) Applicant: Fabio Perini, Viareggio (IT)

(72) Inventor: Fabio Perini, Viareggio (IT)

( * ) Notice: Subject to any disclaimer, the term of this patent is extended or adjusted under 35 U.S.C. 154(b) by 135 days.

(21) Appl. No.: 14/032,761

(22) Filed: Sep. 20, 2013

(65) Prior Publication Data

US 2014/0018221 A1 Jan. 16, 2014

Related U.S. Application Data

(60) Division of application No. 12/366,149, filed on Feb. 5, 2009, now Pat. No. 8,562,500, which is a continuation of application No. 10/576,591, filed on Jan. 16, 2007, now Pat. No. 7,505,003.

(51) Int. Cl.

| | |
|---|---|
| ***B31C 1/00*** | (2006.01) |
| ***B31C 3/04*** | (2006.01) |
| ***B31C 11/00*** | (2006.01) |
| ***B31C 3/00*** | (2006.01) |

(52) U.S. Cl.

CPC ..... *B31C 1/00* (2013.01); *B31C 3/00* (2013.01); *B31C 3/04* (2013.01); *B31C 11/00* (2013.01)

(58) Field of Classification Search

CPC .... B31C 1/00; B31C 3/00; B31C 3/04; B31C 11/00; B31C 1/083; B31C 13/00; B31B 23/00; B31B 2237/10; B31B 2237/403; B31B 3/00; B31B 19/36; B31F 1/0032; B31F 7/002

USPC ..... 493/276

See application file for complete search history.

(56) References Cited

U.S. PATENT DOCUMENTS 3,081,213 A * 3/1963 Chinn ..... B29C 47/026 118/401
3,400,029 A * 9/1968 Mesrobian ..... B21C 37/123 138/144
3,406,614 A * 10/1968 Martin ..... B31C 3/00 229/4.5
3,424,204 A * 1/1969 Sato ..... B31C 3/00 138/124
3,468,733 A * 9/1969 Dunlap, Jr. ..... B29C 66/61 138/129
3,620,869 A * 11/1971 Stump ..... B29C 53/581 156/190
3,623,929 A * 11/1971 Wannamaker et al. ..... B29C 53/60 156/190
4,156,398 A * 5/1979 McDaniel ..... B65B 51/023 118/313
4,196,037 A * 4/1980 Berg ..... B31C 3/04 156/429

(Continued)

*Primary Examiner* — Sameh Tawfik
(74) *Attorney, Agent, or Firm* — McGlew and Tuttle, P.C.

(57) ABSTRACT

Method for producing cardboard tubes by winding a plurality of ribbons (U, L) onto a spindle (1), a preset number of the ribbons (U, L) being glued in correspondence of the lower or radial inner surface thereof, characterized in that a predetermined amount of supplementary quick setting glue is applied on the lower surface of the last ribbon (U) destined to be wound on the spindle (1), in proximity to at least a longitudinal edge (BU) of the ribbon (U) forming a corresponding stripe of quick setting glue (G) astride of a section (ST) of the same ribbon interested or intersected by a subsequent cutting action executed downstream of the spindle (1).

18 Claims, 5 Drawing Sheets

(56) References Cited

U.S. PATENT DOCUMENTS

| | | | | | |
|---|---|---|---|---|---|
| 4,540,392 | A * | 9/1985 | Junod | B23K 26/265 | 156/272.8 |
| 4,836,440 | A * | 6/1989 | French | B31B 1/60 | 229/132 |
| 5,556,365 | A * | 9/1996 | Drummond | B65D 3/266 | 493/287 |
| 5,829,669 | A * | 11/1998 | Drummond | B29C 53/78 | 229/4.5 |
| 5,876,502 | A * | 3/1999 | Sugimura | B31B 1/62 | 118/315 |
| 6,254,710 | B1 * | 7/2001 | Sekar | B05C 17/0207 | 156/187 |
| 6,296,600 | B1 * | 10/2001 | Drummond | B31C 3/04 | 493/269 |
| 6,558,306 | B2 * | 5/2003 | Lowry | B65D 3/04 | 493/269 |
| 6,586,050 | B1 * | 7/2003 | Fort | B65B 51/023 | 427/208.6 |
| 6,858,250 | B2 * | 2/2005 | Fort | B65B 51/023 | 427/207.1 |
| 7,527,586 | B2 * | 5/2009 | Rummage | B31C 3/00 | 242/118.32 |
| 7,618,360 | B2 * | 11/2009 | Daher | B31B 19/62 | 118/315 |
| 7,731,647 | B2 * | 6/2010 | Duwendag | B05C 5/0279 | 493/218 |
| 8,142,587 | B2 * | 3/2012 | Sekar | B29D 99/0035 | 156/184 |

* cited by examiner

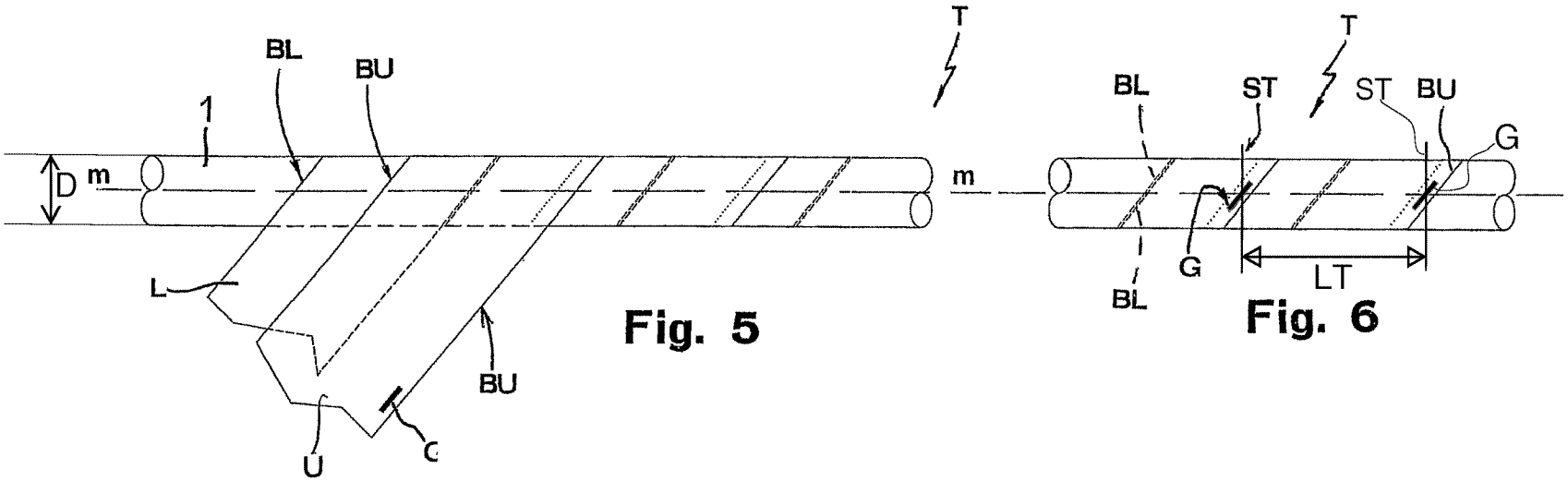
Fig. 5
Fig. 6
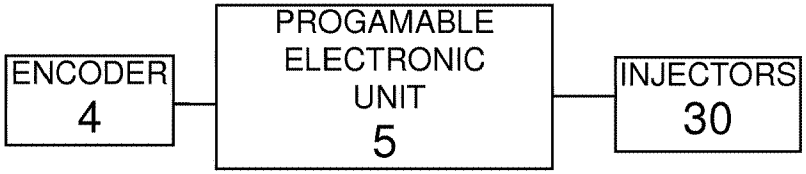
Fig. 7

MACHINE AND METHOD FOR PRODUCING CARDBOARD TUBES

CROSS REFERENCE TO RELATED APPLICATIONS

This is a divisional of, and claims the benefit (35 U.S.C. § 120) of, copending U.S. patent application Ser. No. 12/366,149 filed Feb. 5, 2009, which is a continuation of and claims the benefit (35 U.S.C. § 120) of copending U.S. patent application Ser. No. 10/567,591 filed Feb. 6, 2006, which is a United States National Phase Application of International Application PCT/IT2005/000046 and claims the benefit of priority under 35 U.S.C. § 119 of Italian Patent application FI2004A000046 filed Feb. 24, 2004, the entire contents of all are incorporated herein by reference.

FIELD OF THE INVENTION

The present invention pertains to a machine and a method for producing cardboard tubes.

BACKGROUND OF THE INVENTION

It is known that a machine for producing cardboard tubes basically comprises:

- means for continuously feeding two or more ribbons made of paper or similar material, at least one ribbon being provided with a predetermined amount of glue in correspondence of one of its sides, the ribbons being drawn from corresponding bobbins which are supported by the feeding means;
- belt type means, which are positioned downstream of the feeding means, for winding and advancing the ribbons onto a spindle, forming a plurality of spirals which are overlapped and staggered according to a predetermined staggering step, so that the tube results from the reciprocal overlapping and gluing of the ribbons which are spirally wound on the spindle;
- means, which are positioned downstream of the spindle, for cutting the continuous tube into elements having a predetermined length.

The first ribbon, i.e. the ribbon destined to directly contact the spindle, is not glued, to avoid its adhesion to the spindle surface.

In practice, the belt means, which are positioned onto the spindle downstream of with respect to the feeding direction of the ribbons, drawn the ribbons by exerting on them a traction force which is directed towards the spindle and, while it is forming, the tube made by the overlapped spiral ribbons advances and rotates about the longitudinal axis of the spindle.

The intervention rate of the cutting means depends on the advancing speed of the tube onto the spindle and on the predetermined length of the elements obtained from the tube.

Such a machine is described in WO 95/10400 and WO 95/10399.

One of the main drawbacks deriving from of such machines lies in a cleavage of the tube in correspondence of the cut sections. This drawback is even more evident when the operative speed of the machine increases.

SUMMARY OF THE INVENTION

The main aim of the present invention is to eliminate this drawback.

The cleavage occurs because the primary glue or adhesive used to attach the second ribbon to the first ribbon, is not strong enough to prevent cleavage. The primary glue or adhesive is sufficient to give sufficient strength to form the middle portions of the tube, but when the continuous tube is cut into smaller tube portions, especially at high speed, cleavage occurs at the ends of the smaller tube portions. The primary glue or adhesive, while sufficient for the middle portions of the tube, is not sufficient at the tube cut positions to prevent cleavage, especially when the individual smaller tube portions are cut from the continuous tube at high speed. The eliminating of cleavage has been achieved, according to the invention, by a method for producing cardboard tubes by winding a plurality of ribbons onto a spindle, where a preset number of the ribbons are glued in correspondence of the lower surface thereof. A predetermined amount of supplementary quick setting glue is applied on the lower surface of the last ribbon destined to be wound on the spindle. This supplementary glue is arranged in proximity to at least a longitudinal edge of the ribbon forming a corresponding stripe of quick setting glue astride or adjacent a ribbon cut position or section (ST) of the ribbon. This section (ST) is arranged to be acted on by a subsequent cutting action executed downstream of the spindle at a tube cut position. The application of the at least one stripe of supplementary glue is operated at intervals corresponding to a preset length of the last ribbon.

The present invention also relates to a cardboard tube producing machine, with a structure supporting feeding means for a plurality of ribbons of paper or paper-like material, and a spindle. The ribbons are wound on the spindle. The ribbons are glued in correspondence of the respective lower surfaces, with the exception of the first ribbon which is destined to the direct contact with the spindle. Means are provided for moving the ribbons and winding them on the spindle. The machine also comprises supplementary glue means disposed and acting along a path of the ribbon, the upper surface of which is destined to define the outer surface of a tube. The supplementary glue means distributes a stripe of supplementary quick setting glue in proximity to almost a longitudinal edge of the lower surface of the ribbon astride of a section of the latter interested by a subsequent cutting operation downstream of the spindle. The supplementary glue means being operated at intervals corresponding to a present length of the last ribbon.

Thanks to the present invention, it is possible to increase the operative speed of the machine, i.e. the feeding speed of the ribbons and, consequently, the tubes producing speed, without the aforesaid cleavage effect.

Furthermore, a machine according to the present invention is relatively simple to make, cost-effective and reliable even after a prolonged service life and it may also be realized by modifying the existing machines, without adversely affecting the functionality thereof, at a cost which is very low when compared with the advantages which are obtained.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 5 is a schematic plan view of two ribbons of different width at the entrance of the section of the machine comprising the spindle: in the figure is shown a gluing line applied on the lower surface of the wider upper ribbon, even if this line is on the other face of the sheet;

FIG. 6 is a schematic plan view of a tube portion obtained by the winding of the two ribbons of FIG. 5;

FIG. 7 is a simplified block diagram of the control system driving the means for applying a supplementary amount of quick setting glue;

DESCRIPTION OF THE PREFERRED EMBODIMENTS

Figure 1:
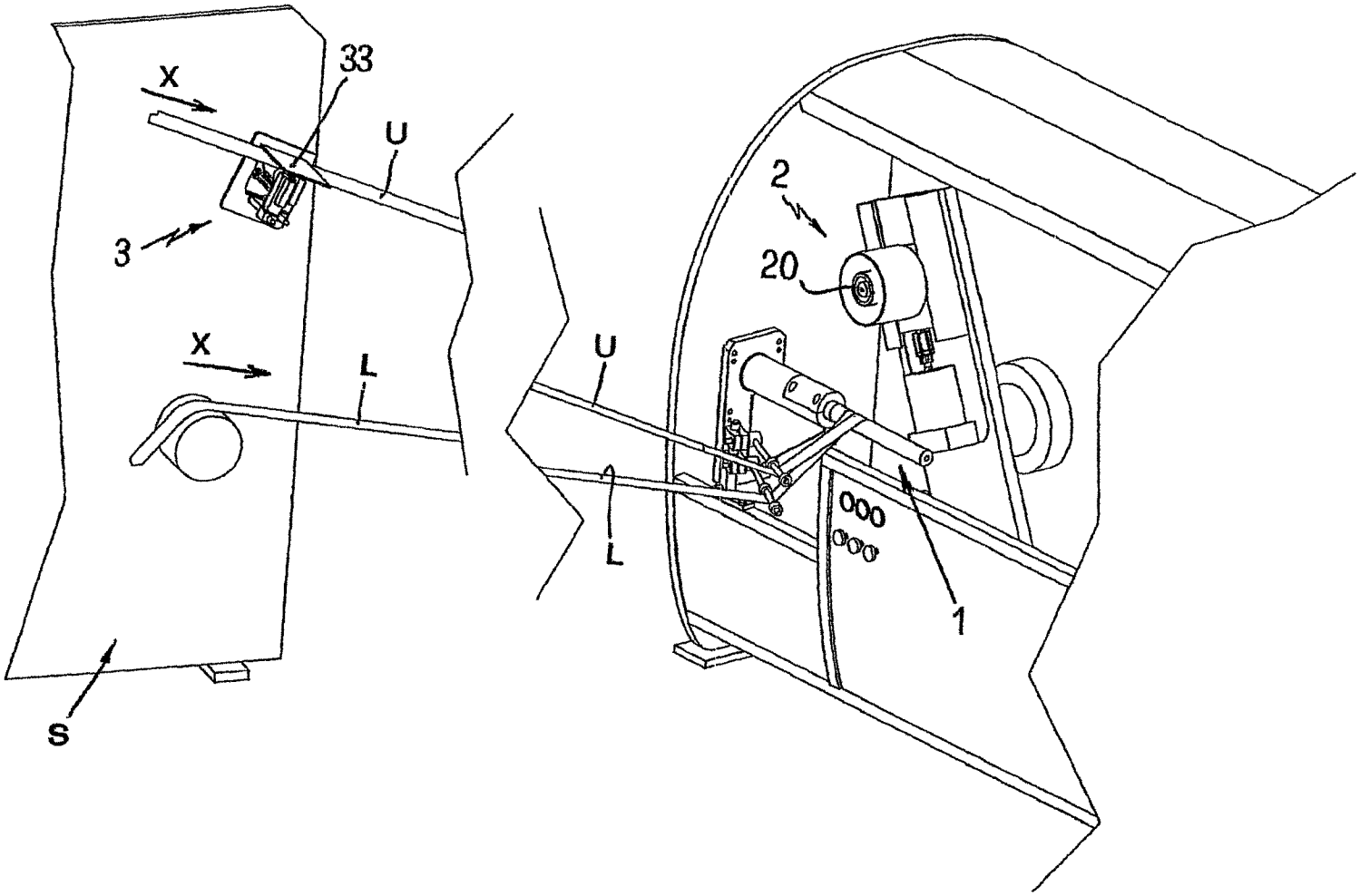
FIG. 1 is a partial perspective view of a machine according to the present invention.
Figure 2:
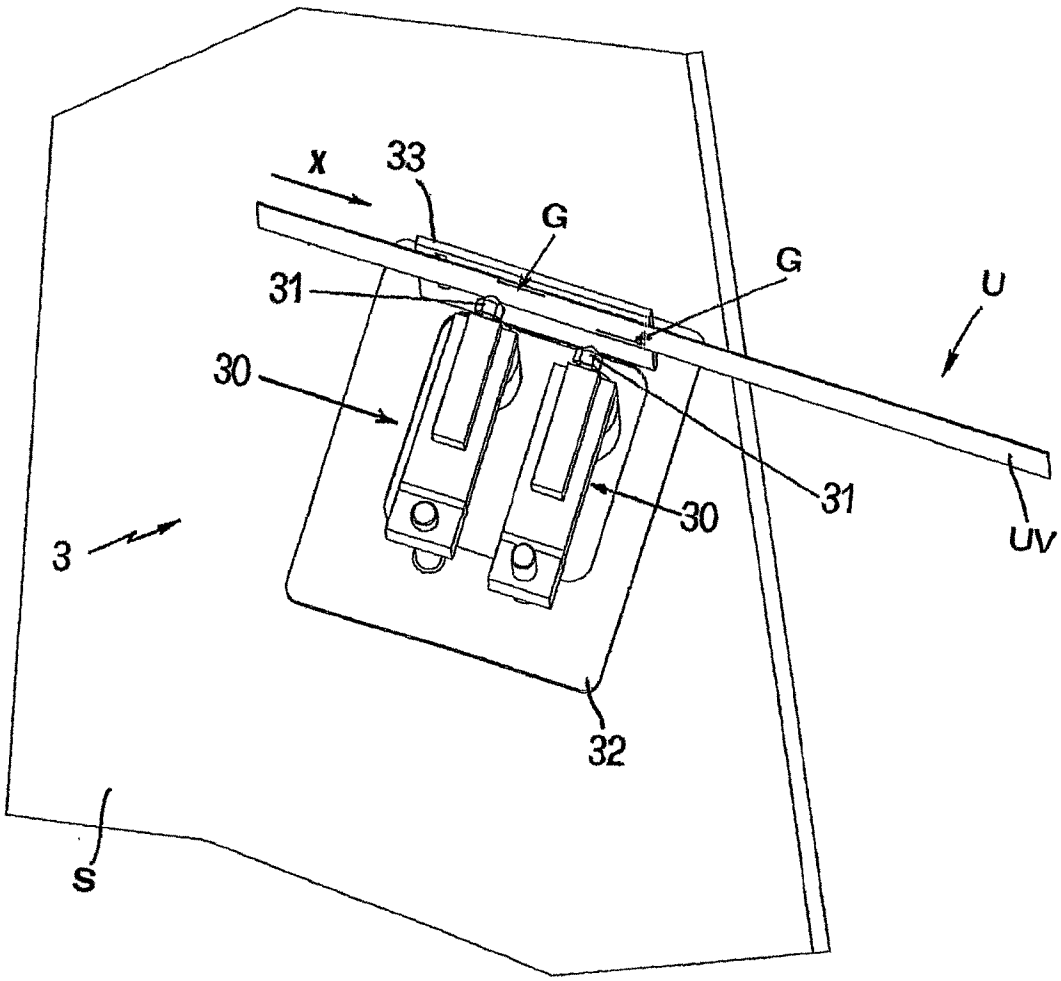
FIG. 2 is a view of a particular area, represented in perspective view from the bottom, relating to the injectors for the application of the glue on the lower surface of the second ribbon treated in the machine of FIG. 1.

Referring to the drawings in particular, a machine according to the present invention comprises, similarly to the conventional machines:

- a structure (S) supporting a plurality of bobbins (not shown for sake of simplicity) from which are unwound more ribbons (U, L) of paper or paper-like material;
- a plurality of gluing rolls (not shown for sake of simplicity) which are disposed downstream of the bobbins in respect to the advancing direction (X) of the ribbons (U,L) along a wall of the structure (S) and which are feed by corresponding tanks (also not shown for sake of simplicity) containing liquid glue, for applying a predetermined amount of glue on the lower surface of each of the advancing ribbons (U, L), with the exception of the first ribbon (L), i.e. with the exception of the ribbon (L), the lower surface of which is destined to the direct contact with a spindle 1 disposed downstream, on which the tubes are formed;
- a spindle 1 which is longitudinally developed along the direction of the tube to be produced, the ribbons (U, L) being wound onto the spindle forming a plurality of superimposed and staggered spirals;
- belt means 2, with relevant motor means 20, for spirally winding the ribbons (U, L) onto the spindle 1 and advancing the forming tube along the longitudinal axis (m-m) of the same spindle 1;
- cutting means (not shown for sake of clarity) for subdividing the tube (T) into portions or tubular elements having a predetermined length.

As stated above, the feeding and gluing means acting on the ribbons (U, L), the winding means and the means for cutting the tube (which results from the overlapping and reciprocal gluing of the ribbons spirally wound onto the spindle) are known to those skilled in the art and, therefore, it is omitted a more detailed description thereof. The gluing of the lower surface of the ribbons (U, L) is made, according to a known technique, upstream of the spindle 1, by means of liquid glue, the liquid glue exploiting its adhesive power in a relatively long time to avoid that it became dry along the path between the gluing station (i.e. the station where the tanks containing the liquid glue are positioned) and the spindle 1.

The machine comprises means 3 for applying a predetermined amount of supplementary glue of the quick setting type to the lower surface (i.e. the surface destined to look at the spindle 1) of at least one of the ribbons which are wound onto the spindle 1 and, more precisely, to the lower surface of the last ribbon, i.e. that ribbon the upper surface of which defines the external surface of the tube.

The means 3 are connected to a tank for the quick setting glue which, for sake of simplicity, is not shown in the enclosed drawings.

The wording "quick setting glue" denotes a glue having a high adhesive power acting in a short time.

With reference to the examples shown in the enclosed drawings, the means 3 distribute the quick setting glue on the lower surface of the second ribbon (U), which is the last ribbon and travels along a path overhanging the advancing path of the first ribbon (L), the tube being constituted by only two ribbons spirally wound and superimposed.

When the ribbons are three instead of two, the means 3 distribute the glue on the lower surface of the third ribbon, i.e. always on the lower surface of the last ribbon.

According to the example shown in the drawings, the means 3 comprise a distributor apt to distribute "hot melt" glue, whose body is solid to the structure (S), in such a manner to result downstream of the gluing rolls and upstream of the spindle 1. The distributor 3 comprises a couple of injectors 30 fixed to a plate 32 solid to the structure (S) near the exit section of the latter, with the respective nozzles 31 directed to the lower surface (UV) of the ribbon to be treated (in the example, the lower surface of the second ribbon U). In correspondence with the injectors 30, the ribbon (U) to be treated is kept in guide by a wing 33 of the plate 32 oriented parallel to the advancing direction (X) of the ribbon and which is spaced from the nozzles 31 of the two injectors 30 in such a manner that the ribbon (U) passes through the space between the wing 33 and the nozzles 31, with the upper surface turned towards the wing 33 and the lower surface (UV) turned towards the nozzles 31. The injectors 30 are disposed and acting in such a manner to distribute a preset amount of quick setting glue (for example, a "hot melt" glue) in correspondence of at least one of the longitudinal edges of the lower surface (UV) of the ribbon (U) advancing towards the spindle 1. Preferably, the injectors 30 distribute a preset amount of quick setting glue in proximity to both the longitudinal edges (BU) of the last ribbon (U) if this has the same width of the underlying ribbon (L) and in correspondence of only one edge (BU) if the upper ribbon (U) has a greater width than the lower ribbon (L). Obviously, also in the second case it is possible to distribute quick setting glue on both the longitudinal edges of the upper ribbon or last ribbon (U).

Figure 3:
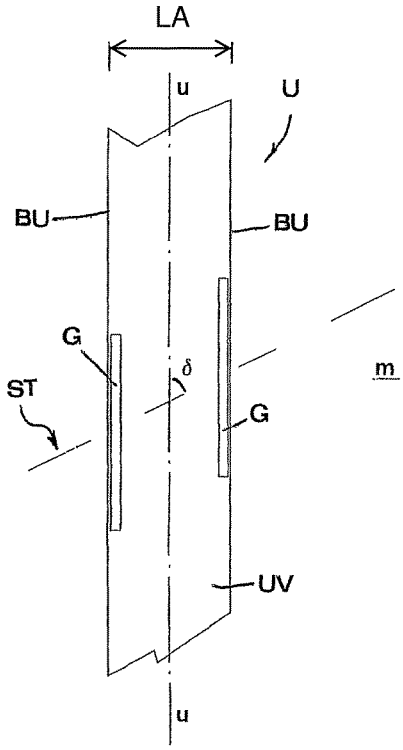
FIG. 3 is a schematic view of the lower surface of a portion of the second ribbon treated in the machine of FIG. 1, in which, in particular, is shown the relative position of two gluing lines.

Referring to the first of the two examples, i.e. when the two ribbons (U) and (L) have the same width, the injectors 30 are activated, for a preset time, in such a manner to apply two stripes of quick setting glue (G) on the lower surface (UV) of the last ribbon (U) astride of a ribbon cut position or section (ST) subsequently involved by the action of the cutting means acting downstream of the spindle 1 at a tube cut position. The section (ST) is, as more clearly shown in FIG. 3, inclined of a preset angle 5) in respect to the longitudinal axis (u-u) of the ribbon (U). The angle (δ) is the complementary of the angle formed by the plan projection of the longitudinal axis of each ribbon (L, U) with the longitudinal axis (m-m) of the spindle 1 when the ribbons are wound on the latter (see FIG. 4); furthermore, this angle corresponds to the angle formed by each stripe of quick setting glue (G) with the section (ST).

Figure 4:
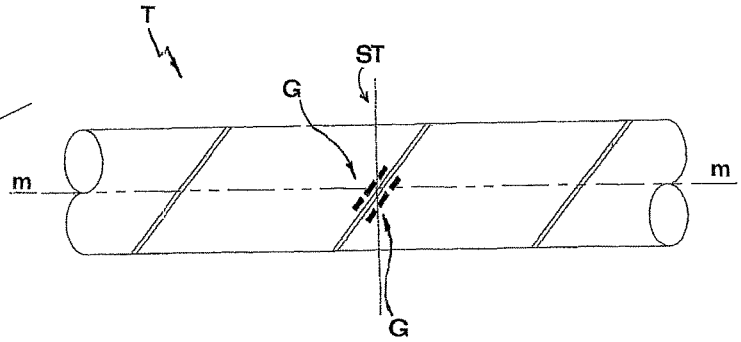
FIG. 4 is a schematic plan view of a tube portion obtained by the spiral winding of two ribbons of the same width, in which, in particular, are shown the two gluing lines of FIG. 3.

As shown in FIG. 4, when the tube formed by the spirals of the ribbons (U, L) wound on the spindle 1 is cut, since the cut is operated in correspondence of the section interested or arranged by the stripes of quick setting glue (G), both the stripes (G) are cut and a portion of each of them is both upstream and downstream of the cutting section.

Figure 9:
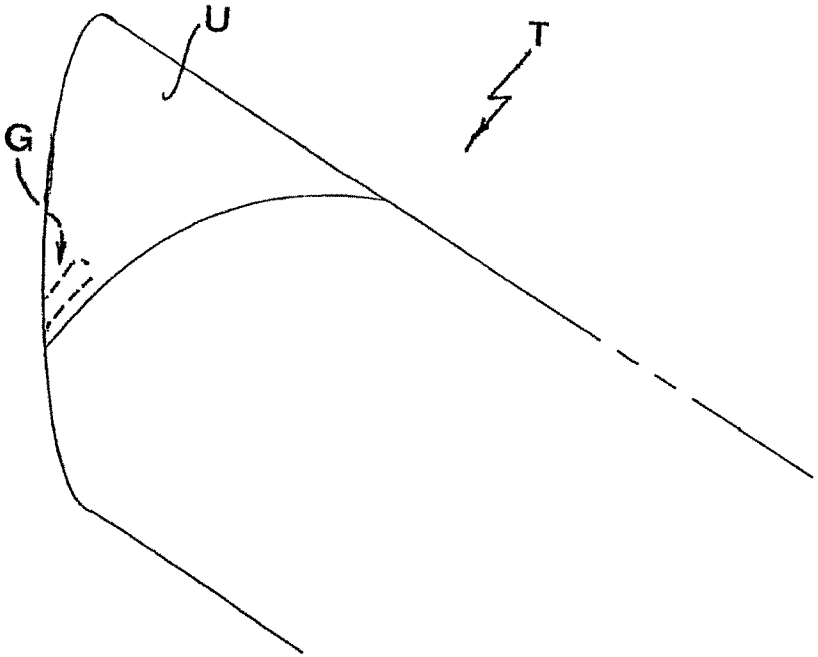
FIG. 9 is a representation similar to that of FIG. 8 but referred to a cardboard tube obtained according to the present invention.
Figure 8:
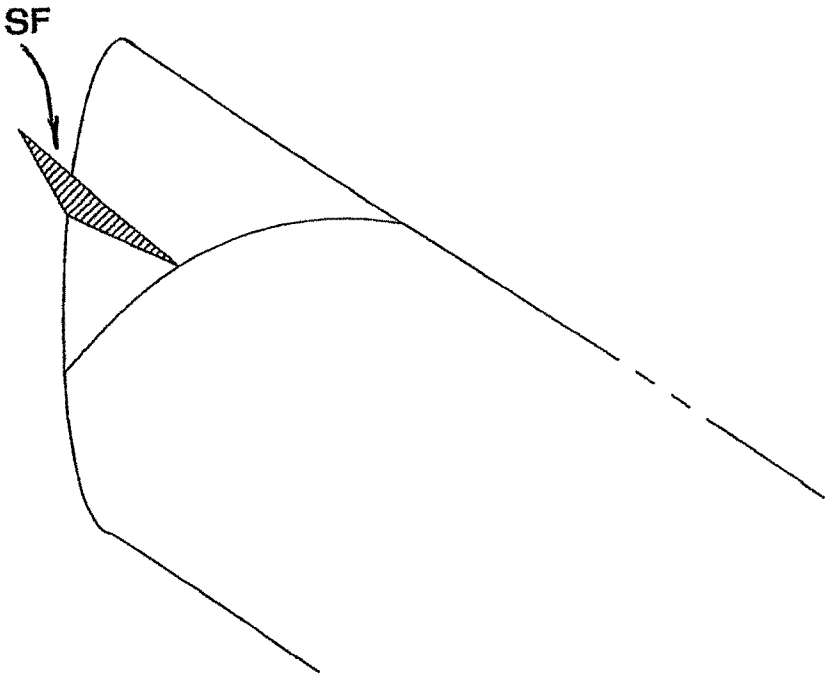
FIG. 8 is a schematic representation relating to the cleavage of a conventional cardboard tube in correspondence of an end section.

Therefore, when the cut is executed, both upstream and downstream of the section (ST) the corresponding edges of the ribbons (U, L) are strongly anchored to each other. In this way, it is avoided the cleavage phenomenon characteristic of the tubes produced by the conventional machines, schematically represented in FIG. 8, where "SF" denotes an edge of the last ribbon detached from the underlying ribbon in correspondence of an end section of the tube, i.e. in correspondence of the section interested or arranged by the cut. On the contrary, as shown in FIG. 9. a tube (T) according to the present invention is exempt from such phenomenon.

Referring to the second example, since the last ribbon (U), i.e. the ribbon whose upper surface defines the outer surface of the tube (T), is wider than the underlying ribbon (L), it can be sufficient to distribute a preset amount of supplementary quick setting glue in correspondence of only one of its longitudinal edges (BU).

In the scheme or embodiment of FIG. 5, the glue stripe (G) is represented with continuous line, even if it is on the opposite face of the sheet and it is in proximity to the right edge (BU) of the ribbon (U). In the scheme of FIG. 6, the discontinuous lines marked by the reference (BL) correspond to the coinciding edges of the lower ribbon (L), spirally wound on the spindle 1 and the glue stripe (G) is represented with continuous line, even if it is on the lower surface of the last ribbon (U), for a better highlight of the same.

When only one supplementary glue stripe (G) is to be applied, then it is activated only the corresponding injector 30 instead of both the injectors.

Therefore, the two injectors 30 are placed in such a way to have the respective nozzle 31 disposed on the plane defined by the section (ST) and are activated at the same time for applying two stripes of quick setting glue (G) astride of the section (ST).

The distance between the nozzles 31 of the two injectors 30 depends on the width (LA) of the ribbon (U).

The activation of the injectors 30 is operated on the basis of the length (LT) of the completed tubes to be produced, i.e. in function of the length (LT) of the tubes obtained from the cutting of the ribbons wound and glued spirally on the spindle 1. The actual length (LT) of the finished tubes are determined by the user or customer and is the length between the tube cut positions (ST). Once the tube cut lengths are determined by the user, the corresponding positions on the ribbon where the cutting of the tube will cut the ribbon, also need to be determined, i.e. the ribbon cut positions, also indicated by (ST) in FIG. 3. The length between the ribbon cut positions are determined by simple mathematics. For example, calling "LA" the width of the ribbon (U), "D" the diameter of the spindle and "LT" the length of the tube to be produced, the length between the ribbon cut positions is equal to $LT*D*\pi/LA$. The injectors 30 are correspondingly activated for a preset time when they pass a corresponding portion of ribbon (U) of length equal to $LT*D*\pi/LA$. The activation time of the injectors is preset on the basis of the desired length of each stripe of supplementary quick setting glue (G).

The control of the amount of ribbon (U) which advances in front of the nozzles 31 of the injectors 30 can be operated by means of an encoder (4) mounted on the axis of an idly roll having a surface covered by friction material; the ribbon passes on this surface, around the roll and determines the rotation of the same roll. This control system, disposed upstream of the means 3, is well known in the technical field. The encoder 4 is connected with a programmable electronic unit 5 apt to receive the data from the encoder 4 for processing them on the basis of the formula previously indicated and apt to operate the activation of the injectors 30 when the preset length value is reached. The structure and the working of the electronic control means are known by the technicians of the industrial automation and, therefore, aren't described in detail.

According to present invention, an operational method involves to apply, in addition to the glue normally used for obtaining the reciprocal attachment of the two ribbons (U, L) spirally wound, a preset amount of supplementary quick setting glue (for example, a "hot melt" glue) in correspondence of the interface between the penultimate ribbon and the last one, astride of a section (ST) subsequently interested by the action of the cutting means downstream of the spindle 1.

Practically, all the construction details may vary in any equivalent way as far as the shape, dimensions, elements disposition, nature of the used materials are concerned, without nevertheless departing from the scope of the adopted solution idea and, thereby, remaining within the limits of the protection granted to the present patent for invention.

While specific embodiments of the invention have been shown and described in detail to illustrate the application of the principles of the invention, it will be understood that the invention may be embodied otherwise without departing from such principles.

What is claimed is:

1. A method for producing cardboard tubes, the method comprising:

winding a plurality of ribbons onto a spindle;

glueing a preset number of the ribbons in correspondence of a radial inner surface thereof; and applying a predetermined amount of supplementary quick setting glue on a radial inner surface of the last ribbon of the preset number of the ribbons destined to be wound on the spindle, in proximity to a longitudinal edge of the last ribbon forming a corresponding stripe of quick setting glue astride of a cut section of the last ribbon intersected by a subsequent cutting action executed downstream of the spindle, the supplementary stripe of quick setting glue extending on both sides of the cut section, the stripe of quick setting glue extending along a direction parallel to a direction along which the last ribbon moves while the supplementary quick setting glue is applied, the cut section being inclined at a preset angle in respect to a longitudinal axis of the last ribbon, said angle being less than 90° , said applying of the supplementary quick setting glue being supplemental to said glueing of the preset number of ribbons, said applying of the strip of supplementary quick setting glue includes applying first and second separate strips of glue at first and second separate longitudinal edges of the last ribbon, and is not performed between the first and second longitudinal edges of the last ribbon.

2. A method according to claim 1, wherein:

another stripe of supplementary quick setting glue is distributed in proximity to another longitudinal edge of the last ribbon.

3. A method according to claim 1, wherein:

the quick setting glue is a "hot melt" glue.

4. A method according to claim 1, wherein:

the stripes of supplementary quick setting glue are distributed by two injectors acting along an advancing path of the ribbon upstream of the spindle.

5. A method according to claim 1, wherein:

all the ribbons are of the same width.

6. A method according to claim 1, wherein:

said applying of the stripe of supplementary quick setting glue is performed at intervals corresponding to a preset length of the last ribbon;

the preset length of the last ribbon depends on a length of the tubes to be obtained.

7. A method according to claim 1, wherein:

said applying of the stripe of supplementary quick setting glue is performed at intervals corresponding to a preset length of the last ribbon;

a structure is provided for supporting feeding means for said winding of the plurality of ribbons of paper or paper-like material on the spindle; and distributor means is disposed and acts along a path of the last ribbon, a first surface of which is destined to define a radial outer surface of a tube, said distributor means distributing the stripe of supplementary quick setting glue in proximity to a longitudinal edge on a second surface of said ribbon astride of a section of the last ribbon intersected by a subsequent cutting operation downstream of the spindle, the second surface being diametrically opposite the first surface, the distributor means being operated at the intervals corresponding to the present length of the last ribbon.

8. A method according to claim 7, wherein:

the distributor means of supplementary quick setting glue includes a plurality of injectors fixed to a plate that is fixed to the structure near an exit section of the structure, with respective nozzles of the plurality of injectors directed to the second surface of the last ribbon, the last ribbon being kept in guide, in correspondence of the injectors, by a wing of the plate oriented parallel to an advancing direction of the last ribbon and which is spaced from the nozzles of the two injectors, the last ribbon passing through the space between the wing and the nozzles, with the first surface turned towards the wing and the second surface turned towards the nozzles.

9. A method in accordance with claim 1, wherein:

said applying of the supplementary quick setting glue is not performed at or adjacent a middle position between longitudinal edges of the last ribbon.

10. A method in accordance with claim 1, further comprising:

determining a plurality of the cut sections on the last ribbon intersected by subsequent cutting actions executed downstream of the spindle;

said applying of the supplementary quick setting glue includes applying the supplementary quick setting glue to the last ribbon at the plurality cut sections, said applying of the supplementary quick setting glue includes interrupting the applying of the stripe of supplementary quick setting glue in an area between the plurality of cut sections.

11. A method in accordance with claim 1, wherein:

the applying of the supplementary quick setting glue includes arranging the corresponding stripe of quick setting glue to span across the cut section of the last ribbon.

12. A method for producing cardboard tubes, the method comprising:

winding a plurality of ribbons onto a spindle;

glueing a preset number of the ribbons in correspondence of a radial inner surface thereof; and applying a predetermined amount of supplementary quick setting glue on a radial inner surface of the last ribbon of the preset number of the ribbons destined to be wound on the spindle, in proximity to a longitudinal edge of the last ribbon forming a corresponding stripe of quick setting glue extending across a cut section of the last ribbon, the cut section being intersected by a subsequent cutting action executed downstream of the spindle, said applying arranging the supplementary stripe of quick setting glue from one side of the cut section to another side of the cut section, the stripe of quick setting glue extending along a direction parallel to a direction along which the last ribbon moves while the supplementary quick setting glue is applied, said applying of the stripe of supplementary quick setting glue being supplemental to said glueing of the preset number of ribbons, said applying of the strip of supplementary quick setting glue includes applying first and second separate strips of glue at first and second separate longitudinal edges of the last ribbon, and is not performed between the first and second longitudinal edges of the last ribbon.

13. A method in accordance with claim 12, further comprising:

determining a plurality of the cut sections on the last ribbon that will be intersected by subsequent cutting actions executed downstream of the spindle;

the applying of the supplementary quick setting glue includes applying the supplementary quick setting glue to the last ribbon at the plurality cut sections, the applying of the supplementary quick setting glue includes interrupting the applying of the stripe of supplementary quick setting glue in an area between the plurality of cut sections.

14. A method in accordance with claim 12, further comprising:

said winding forming a tube;

determining a tube cut position on the tube where the tube will be cut, with the last ribbon being cut at the tube cut position; and determining a ribbon cut position on the last ribbon before the last ribbon is wound onto the spindle, the ribbon cut position being arranged at the tube cut position when the last ribbon is wound onto the spindle, said applying of the stripe of supplementary quick setting glue to the last ribbon is performed at the ribbon cut position.

15. A method in accordance with claim 14, further comprising:

determining a plurality of the tube cut positions on the tube;

determining a plurality of the ribbon cut positions corresponding to the plurality of the tube cut positions; and applying the stripe of supplementary quick setting glue to the last ribbon at the plurality of ribbon cut positions, the applying of the stripe of supplementary quick setting glue being interrupted in an area between the plurality of ribbon cut positions.

16. A method in accordance with claim 14, wherein:

said glueing of the preset number of the ribbons is performed using a primary adhesive;

the stripe of supplementary quick setting glue is a supplementary adhesive;

said winding of the plurality of ribbons is performed in a helix longitudinally along the spindle;

said applying of the stripe of supplementary quick setting glue includes applying first and second separate stripes of glue at first and second separate longitudinal edges of the last ribbon, and is not performed between the first and second longitudinal edges of the last ribbon;

said applying of the stripe of supplementary quick setting glue is interrupted at or adjacent a middle position between longitudinal edges of the last ribbon; and the tube is to be cut completely radially at the tube cut position.

17. A method in accordance with claim 12, wherein:

said glueing of the preset number of the ribbons is performed using a primary adhesive; and the stripe of supplementary quick setting glue is a supplementary adhesive.

18. A method in accordance with claim 12, wherein:

another stripe of supplementary quick setting glue is performed adjacent another longitudinal edge of the last ribbon.

* * * * *